US005816790A

United States Patent [19]

Ichinose et al.

[11] Patent Number: 5,816,790

[45] Date of Patent: Oct. 6, 1998

[54] HEAVY OIL EMULSIFIED FUEL COMBUSTION EQUIPMENT

[75] Inventors: Toshimitsu Ichinose; Kimishiro Tokuda; Akio Hiraki; Yuichi Hino; Kan Ogata; Tsutomu Hashimoto, all of Nagasaki; Shozo Kaneko, Tokyo, all of Japan

[73] Assignee: Mitsubishi Jukogyo Kabushiki Kaisha, Tokyo, Japan

[21] Appl. No.: 690,104

[22] Filed: Jul. 31, 1996

[30] Foreign Application Priority Data

| | | | |
|---|---|---|---|
| Aug. 25, 1995 | [JP] | Japan | 7-217358 |
| Oct. 4, 1995 | [JP] | Japan | 7-257597 |
| Dec. 13, 1995 | [JP] | Japan | 7-324354 |
| Mar. 14, 1996 | [JP] | Japan | 8-057413 |
| Apr. 24, 1996 | [JP] | Japan | 8-102508 |

[51] Int. Cl.[6] ..... F23J 7/00

[52] U.S. Cl. ..... 431/4; 431/11; 431/12; 431/211; 431/208

[58] Field of Search ..... 431/4, 11, 12, 431/211, 208

[56] References Cited

U.S. PATENT DOCUMENTS

| | | | |
|---|---|---|---|
| 4,302,177 | 11/1981 | Fankhan et al. | 431/11 |
| 4,460,328 | 7/1984 | Niederholtmeyer | 431/11 |
| 4,573,911 | 3/1986 | Kimmich | 432/179 |
| 5,135,386 | 8/1992 | Kellen et al. | 431/11 |
| 5,149,260 | 9/1992 | Foust | 431/11 |
| 5,263,850 | 11/1993 | Walker | 431/11 |
| 5,271,808 | 12/1993 | Shurtleff | 196/46 |
| 5,520,165 | 5/1996 | Khinkis et al. | 126/355 |

*Primary Examiner*—Larry Jones
*Attorney, Agent, or Firm*—Wenderoth, Lind & Ponack, LLP

[57] ABSTRACT

A heavy oil emulsified fuel combustion furnace is provided which prevents lowering of combustion efficiency due to water content in the fuel as well as prevents elevation of sulfuric acid dew point due to water content in the flue gas of the combustion furnace. In the apparatus a heavy oil emulsified fuel (102) is heated by a heater (110) using a heat pipe etc. and then is separated by a water vaporizer (120) into heavy oil (122) and vapor (121) consisting of steam and a light oil combustible gas. The heavy oil (122) is supplied to a burner port of the combustion furnace, such as a boiler etc. The vapor (121) is condensed by a condenser (140) to produce liquid (141) comprising a mixture of water and light oil. The liquid (141) is separated by an oily water separator (150) into oil (151) and water (152). The oil (151) is used as a fuel for an igniting torch of the combustion furnace 10 and the water (152) is used partially as cooling water (41) for an $SO_X$ removal apparatus (40) and partially as an atomizing steam 9 or a soot blowing steam 8 in the boiler, etc.

30 Claims, 14 Drawing Sheets

HEAVY OIL EMULSIFIED FUEL COMBUSTION EQUIPMENT

BACKGROUND OF THE INVENTION

1. Field of the Invention

The present invention relates to a heavy oil emulsified fuel combustion equipment for use in a public utility or industrial combustion furnace, such as a boiler, a gasification furnace, a heating furnace, etc.

2. Description of the Prior Art

FIG. 14 shows a construction of a combustion equipment which is known in the prior art and in which a heavy oil emulsified fuel is fired in a boiler. In FIG. 14, a heavy oil emulsified fuel 101 is directly supplied to a burner of boiler 10 from a fuel tank 100. An atomizing steam 9 for atomizing the heavy oil emulsified fuel 101 is supplied concurrently to the burner and the heavy oil emulsified fuel 101 is atomized to particle sizes at which combustion easily takes place.

Then, the fuel 101 is fired within the boiler 10. On the other hand, another steam 8 is supplied within the boiler 10 for the purpose of blowing off the ash content etc. which is sticking on heat exchanger tubes in the boiler 10. Fuel gas 11 generated in the boiler 10 is sent through an $NO_X$, removal apparatus 20, a dust removal apparatus 30 and a wet type $SO_X$ removal apparatus 40 and is discharged into the air from a stack 50.

In the prior art, while the heavy oil emulsified fuel 101 can be so supplied to the boiler 10 at the ordinary temperature, as the heavy oil emulsified fuel 101 contains a water content of about 20 to 30%, heat to vaporize it in the boiler 10 is required and, as a result, the efficiency of the boiler is reduced.

In the prior art heavy oil emulsified fuel combustion equipment in the prior art, there is a problem in that the efficiency of the combustion furnace is reduced due to the water content in the fuel, as mentioned above, and there is a further problem in that, as a large amount of water is thus contained in the combustion furnace flue gas, a sulfuric acid dew point is elevated due to the water content, so that corrosion occurs at, and soot and dust stick to, the downstream machinery and equipment.

SUMMARY OF THE INVENTION

It is therefore an object of the present invention to provide a heavy oil emulsified fuel combustion equipment or apparatus in which the combustion equipment using the heavy oil emulsified fuel prevents lowering of the combustion furnace efficiency due to the water content in the fuel as well as prevents elevation of the sulfuric acid dew point due to water content in the combustion furnace flue gas.

It is also an object of the present invention to provide a heavy oil emulsified fuel combustion apparatus which can solve a problem of low combustibility, being a shortcoming of heavy oil, by producing fine particles of oil at the time of combustion.

In the present invention, in order to solve the problems in a heavy oil emulsified fuel combustion apparatus, the heavy oil emulsified fuel is heated and dewatered, and the fuel, after being dewatered, is used as a fuel for the combustion furnace. At least a portion of the water obtained by the dewatering process is supplied to a water utilizing line of the combustion furnace to be used as a replacement of the water which has been supplied from other sources.

For heating the heavy oil emulsified fuel for dewatering, a combustion furnace flue gas can be used as a heat source.

In this case, an economizer is preferably provided respectively on the upstream side of a take-out portion of the combustion furnace flue gas and on the downstream side of a return portion of the combustion furnace flue gas.

For heating the heavy oil emulsified fuel by the combustion furnace flue gas, it is preferable for protection against fire that a heat exchange is made by a heat pipe method using a heating medium of water etc. so as to heat the heavy oil emulsified fuel.

Further, in the present invention, as for a water utilizing line of the combustion furnace to which the water obtained by dewatering the heavy oil emulsified fuel is supplied, a burner atomizing steam line, a soot blowing steam line, an $SO_X$ removal apparatus cooling water line, etc. are considered.

Moreover, in the heavy oil emulsified fuel combustion apparatus according to the present invention, steam and a light oil combustible gas generated by the heavy oil emulsified fuel being heated for dewatering may be cooled to be condensed, and separated into water and oil.

In this case, it is preferable that the steam and light oil combustible gas generated at the time when the heavy oil emulsified fuel is heated are cooled by heat exchange with the heavy oil emulsified fuel, before being heated, so that the heat used for heating the heavy oil emulsified fuel for dewatering is recovered.

Incidentally, in order to make the water content in the heavy oil less than 1%, it is preferable to provide two or more units of a means to heat and dewater the heavy oil emulsion, such as f flasher of heater etc.

As the heavy oil is of a high consistency, if a same atomized character as C heavy oil (atomizing temperature being 95° C.) is to be obtained, temperature elevation to 190° C. for bitumen and to 230° C. for asphalt is necessary (see FIG. 12). And the heavy oil itself, having plenty of residual carbon content, is a low combustible oil.

So, in order to improve the combustibility of the heavy oil fuel recovered after the heavy oil emulsion is dewatered, the atomized oil particles (of about 100 $\mu$m) in the combustion furnace are made finer particles by making use of a phenomena in which a small amount of water particles is boiled to produce fine particles, thereby it is intended that the surface area of oil particles is increased so that burning out of the fuel is attained.

Accordingly, in the present invention, in case the heavy oil emulsion is dewatered, it is preferable that a necessary amount of water remains, which amount is 0.5 to 10 wt %, preferably 1 to 5 wt %.

Further, in the case where water particles in the fuel are large, a high shear type mixer, such as a high shear type turbine mixer, a colloid mill, a homogenizer, etc., an orifice or a valve is provided in the line for the purpose of effecting a high shear. Thereby, the size of the water particles in the fuel is reduced to less than 100 $\mu$m, preferably less than 50 $\mu$m, and a water-in-oil type emulsion is formed.

If there is a need to further accelerate fine water particles to obtain stabilized water particles, a small amount of surface active agent represented by a polyoxyethylene nonyl phenyl ether (HLB 1 to 20) is added. As for the surface active agent, such of a low cost and as accelerates emulsification may be used either in a single form or in a mixed form.

If the dewatered heavy oil is exposed to a high temperature atomizing condition, the water contained therein will be vaporized, so there is a need to provide a higher pressure than the saturation vapor pressure (20 kg/cm$^2$ for bitumen, 25 kg/cm$^2$ for asphalt). Therefore, adjustment of the water content and making fine particles are most preferably to occur at the fuel supply line (see FIG. 13).

In the case where the dewatered heavy oil in the fuel tank has a low water content, such a construction to add a make-up water, like a separated water from the heavy oil emulsion, can be employed. Also in the case where the water content in the dewatered heavy oil is distributed unhomogeneously, it can be homogenized by the use of the high shear type mixer or line blender.

Further, the heavy oil emulsified fuel may, prior to being heated and dewatered, be partially dewatered by use of a liquid-liquid separator, and thereby the heat necessary for dewatering by heating can be reduced. It is preferable to circulate a part of the water separated by the liquid-liquid separator to the upstream side of the liquid-liquid separator so that the viscosity of the heavy oil emulsified fuel is lowered at the time of the liquid-liquid separation.

As mentioned above, in the heavy oil emulsified fuel combustion apparatus according to the present invention, the water content in the heavy oil emulsified fuel is dewatered and only the fuel, after being dewatered, is used as the combustion furnace fuel, thereby reducing the combustion furnace efficiency due to a large amount of water being fed into the combustion furnace. Also, as the water obtained by the dewatering process is used as a replacement for the water necessary to be supplied from other sources, the efficiency of the combustion furnace is enhanced as a whole.

Further, in the conventional heavy oil emulsified fuel combustion equipment, the sulfuric acid dew point of the outlet flue gas becomes high due to a large amount of water being fed and therefore troubles occur, such as corrosion of material due to dew formation, soot and dust sticking or accumulation, or even blocking in a worse case, in the downstream machinery and equipment or pipings of the combustion furnace, while in the heavy oil emulsified fuel combustion equipment according to the present invention, the amount of water being fed into the combustion furnace is reduced, and therefore the troubles can be solved.

Moreover, in the heavy oil emulsified fuel combustion equipment according to the present invention, as the heavy oil separated of components of a low boiling point (water and a portion of light oil) is supplied to the burner of the combustion furnace, a vapor lock on the atomizing temperature condition of heavy oil (around 200° C.) is dissolved and a stable combustion of heavy oil is maintained.

While the present invention relates to a heavy oil emulsified fuel combustion apparatus in which a heavy oil emulsified fuel is used separately to fuel and water content as mentioned above, the heavy oil emulsified fuel is made at a source location of the heavy oil, wherein the heavy oil is mixed with water (30% for example) and emulsified with the purpose of improving the transportability and handling ability of the heavy oil which is a high viscosity fluid or solid at an ordinary temperature. This heavy oil emulsified fuel is not necessarily used as it is, but it is dewatered again and used in the combustion equipment according to the present invention, thus an advantage in terms of combustion furnace efficiency is obtained.

DESCRIPTION OF THE PREFERRED EMBODIMENTS

Figure 14:
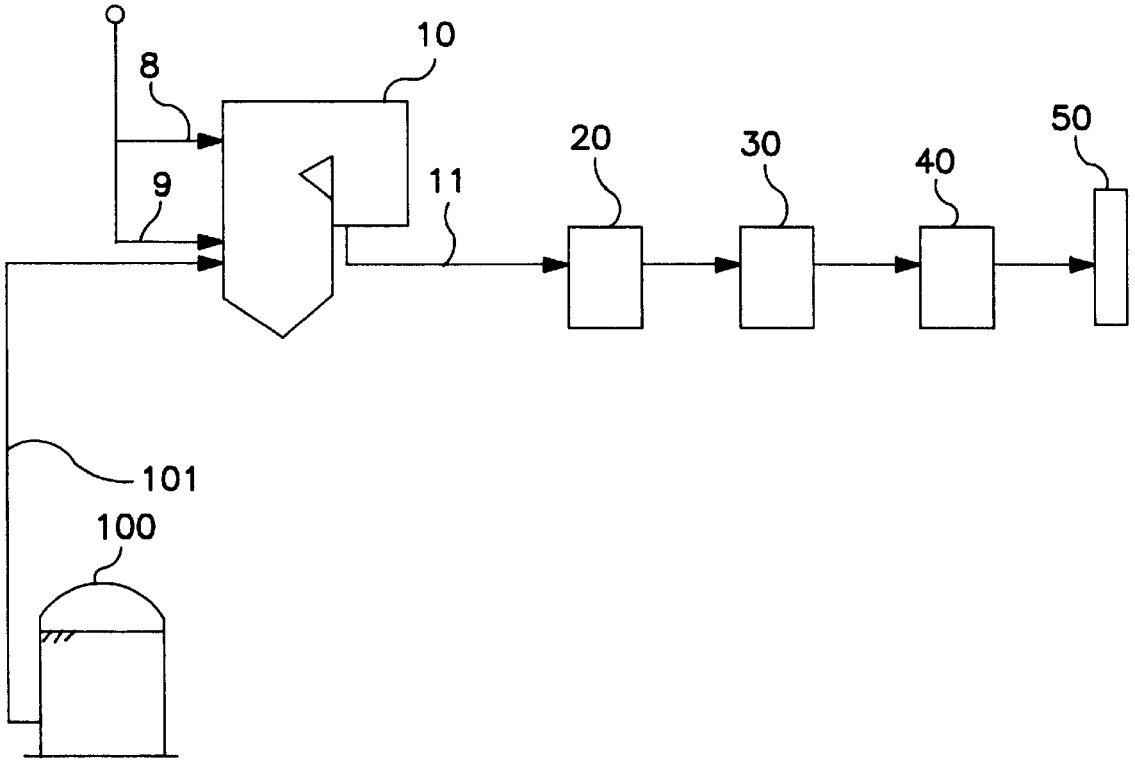
FIG. 14 Prior Art
FIG. 14 is a diagrammatic view of a prior art heavy oil emulsified fuel combustion apparatus.

Herebelow, a heavy oil emulsified fuel combustion equipment according to the present invention is described based on the preferred embodiments shown in FIGS. 1 to 11. Incidentally, in the following preferred embodiments, those parts of construction which are the same as those in the prior art apparatus shown in FIG. 14 are denoted with the same reference numerals for simplicity of description.

(First Preferred Embodiment)

Figure 1:
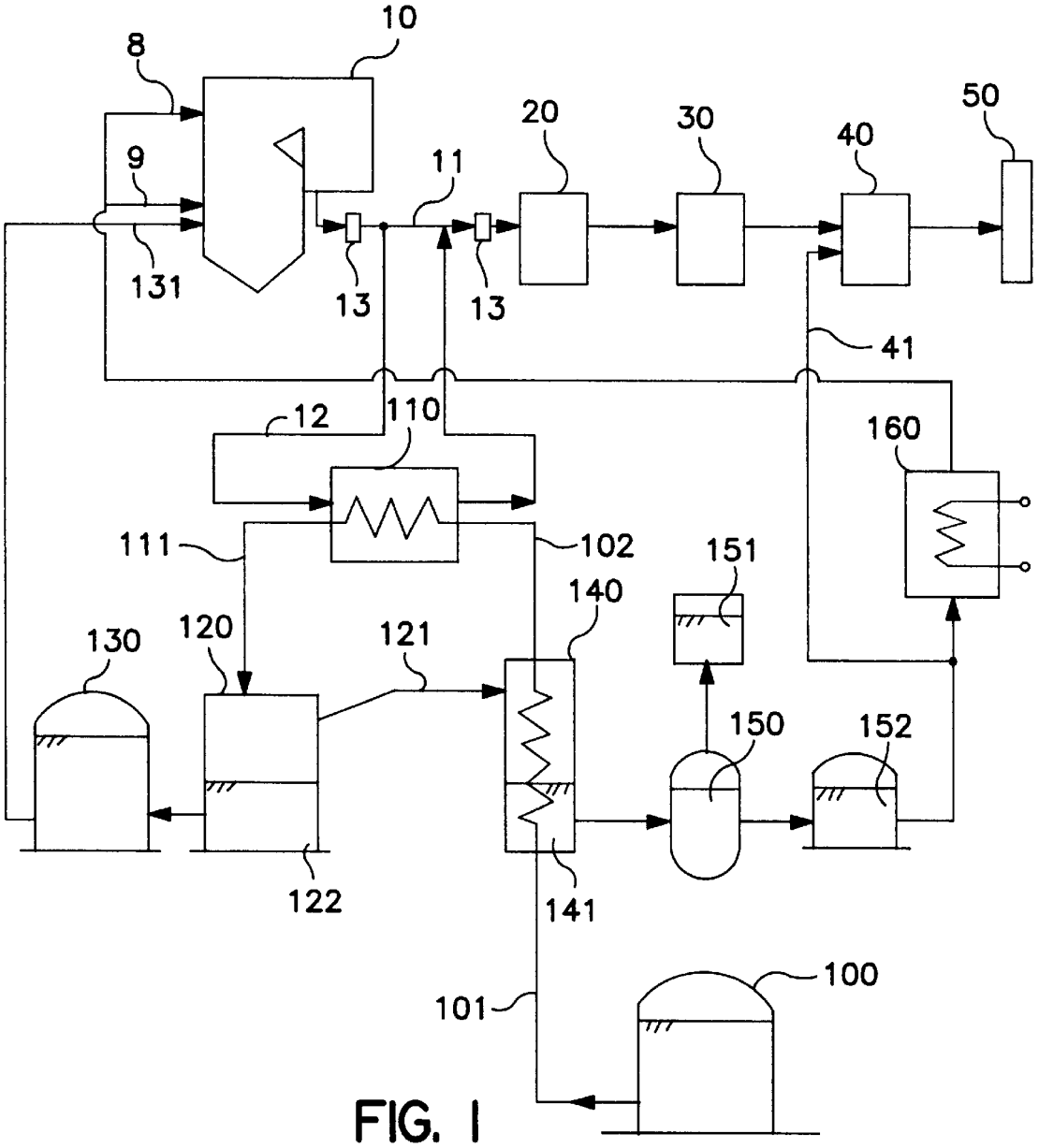
FIG. 1 is a diagrammatic view of a heavy oil emulsified fuel combustion apparatus in accordance with a first preferred embodiment of the present invention.

A first preferred embodiment according to the present invention, shown in FIG. 1, is described. Like the prior art boiler shown in FIG. 14, a heavy oil emulsified fuel combustion boiler shown in FIG. 1 includes a fuel supply line in the heavy oil emulsified fuel combustion boiler having a boiler unit 10, a flue gas treatment line of an $NO_X$, removal apparatus 20, a dust removal apparatus 30, a wet type $SO_X$, removal apparatus 40 and a stack 50, etc. The boiler shown in FIG. 1 is also provided with a dewatering system for dewatering the water content of the heavy oil emulsified fuel. Incidentally, numeral 13 designates an economizer.

The dewatering system in the combustion boiler shown in FIG. 1 is composed of a heavy oil emulsified fuel tank 100, a heavy oil emulsified fuel heater 110, a water vaporizer 120, a storage tank 130 for fuel which has been dewatered, a condenser 140 of vapor obtained by dewatering, an oily water separator 150, a water reheater 160, etc.

The fuel sent from a heavy oil emulsified fuel production source is stored in the fuel tank 100. The heavy oil emulsified fuel 101 sent from tank 100 via a pump (not shown) and absorbs a latent heat of vapor 121 at the condenser 140 to be elevated in temperature.

The heavy oil emulsified fuel 102 coming out of the condenser 140 is further heated by the heater 110 to a temperature at which the water content in the heavy oil emulsified fuel 102 can be vaporized, and is then supplied into the water vaporizer 120. As a heat source for the heater 110, a sensible heat of a partial gas 12 of the boiler flue gas 11 is used.

The partial gas 12 of the boiler flue gas 11 is a combustion flue gas, of about 400° C. for example, taken out of a place in the vicinity of an outlet of the economizer 13 and is returned, after coming out of the heater 110, to the outlet of the economizer 13 or to the flue gas line between the economizer 13 and a next economizer 13.

Figure 7:
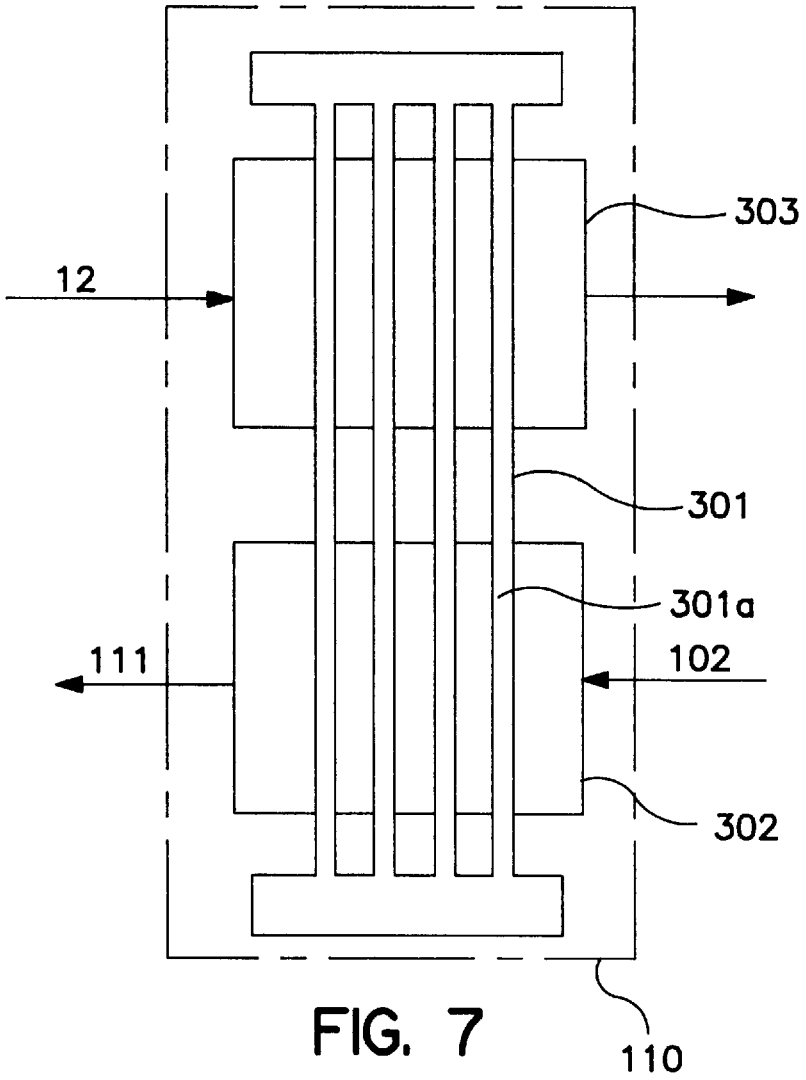
FIG. 7 is an explanatory view showing a construction of the heavy oil emulsified fuel heating apparatus shown in FIG. 1.

A construction of the heater 110 is shown in FIG. 7. In FIG. 7, numeral 301 designates a heat pipe using a heating medium of water etc. 301*a*. Numeral 302 designates a fuel container, in which the heavy oil emulsified fuel 102 coming out of the condenser 140 is heated by the heat pipe 301 provided therein to become a high temperature heavy oil emulsified fuel 111 to be supplied to the water vaporizer 120.

Numeral 303 designates a flue gas container, in which the flue gas 12 of about 400° C. gas temperature taken out of a place in the vicinity of an outlet of the economizer 13 provides heat to the heat pipe 301 provided therein to heat the heating medium in the heat pipe 301. The combustion flue gas coming out of the flue gas container 303 is returned to the outlet of the economizer 13 or to the flue gas line between the economizer 13 and a next economizer 13. It is preferable for protection against fire to heat the heavy oil emulsified fuel in this way with the heater 110 utilizing a heat pipe.

The high temperature fuel 111 supplied to the water vaporizer 120 is separated into heavy oil 122 and vapor 121 consisting of steam and a light oil combustible gas. The heavy oil 122 is stored in the fuel storage tank 130 and is supplied as boiler fuel 131 to a burner port of the boiler 10.

As the heavy oil 122 supplied to the burner port of the boiler 10 is a heavy oil separated from a low boiling point component (water and a portion of light oil), a vapor lock on the atomizing temperature condition of heavy oil (around 200° C.) is dissolved and a stable combustion of heavy oil in the boiler is maintained.

Incidentally, as the heavy oil content 122, after being separated from the vapor 121, consisting of steam and a light oil combustible gas, loses flowability at the ordinary temperature, the fuel storage tank 130 and pipings to the burner port, etc. are required to be heated in order to maintain the flowability of the heavy oil.

The vapor 121 obtained is, for a purpose to recover its latent heat, supplied into the condenser 140 to provide heat to the heavy oil emulsified fuel 101 of the ordinary temperature and is condensed into liquid 141 in which water and a light oil are mixed.

In order to effectively make use of the water and the light oil, respectively, in the same system, the liquid 141 is separated into oil 151 and water 152 by the oily water separator 150, and the oil 151 is used as fuel for a boiler igniting torch etc. and part of the water 152 is used as cooling water 41 for the $SO_X$, removal apparatus 40 and part of the water 152 is heated by the reheater 160, as an atomizing steam 9 of the boiler burner or a soot blowing steam 8 in the boiler, etc.

The atomizing steam 9 and the soot blowing steam 8 are indispensable for the boiler 10, and water which would have to be made available from other sources if no water is obtained from the fuel according to the present invention can be made up by the water recovered from the fuel, hence the amount of water supplied to the boiler 10 can be greatly reduced and efficiency enhancement of the boiler 10 and reliability enhancement of the downstream machinery and equipment can be attained.

(Second preferred embodiment)

Figure 2:
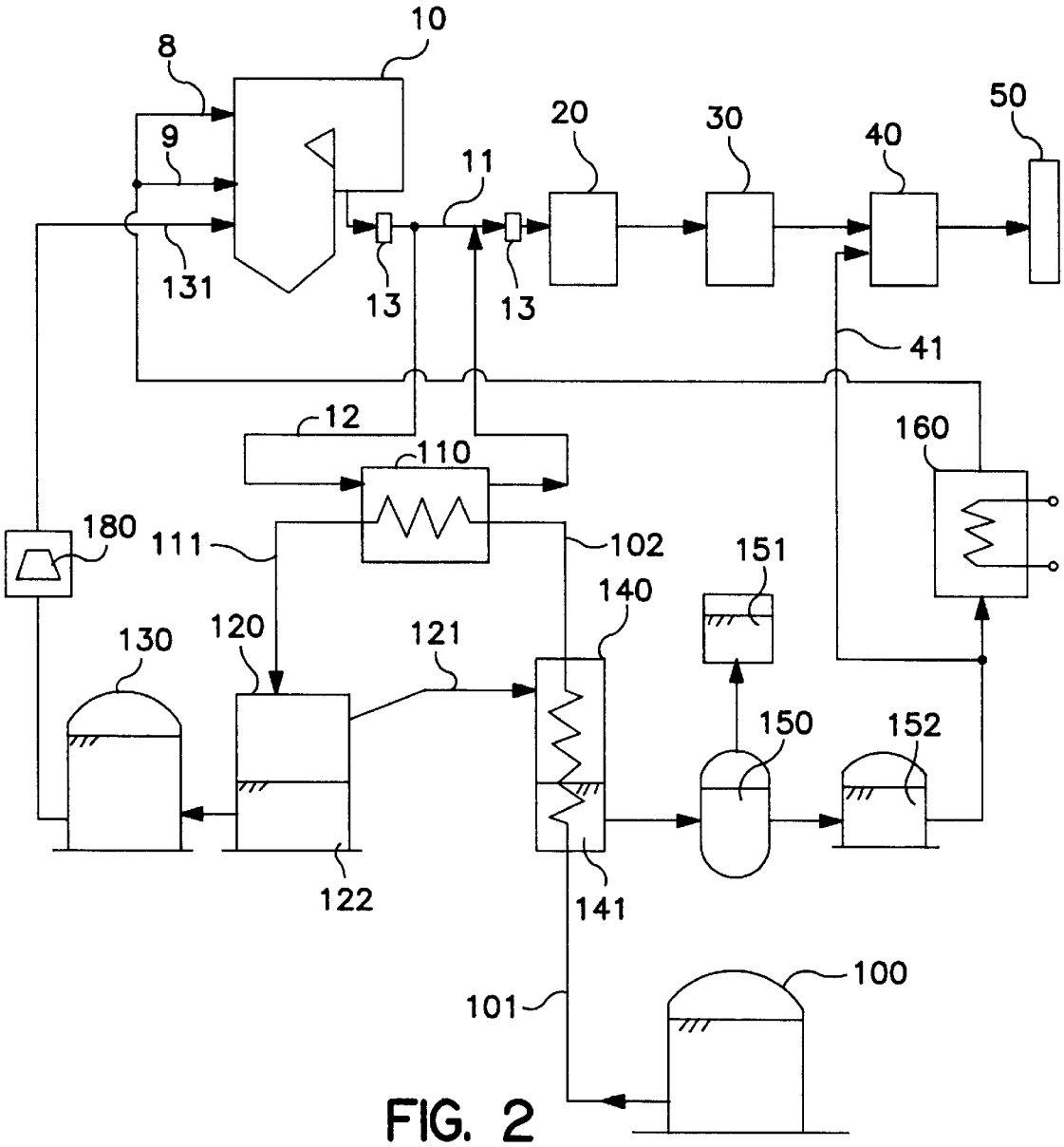
FIG. 2 is a diagrammatic view of a heavy oil emulsified fuel combustion apparatus in accordance with a second preferred embodiment of the present invention.

A second preferred embodiment according to the present invention shown in FIG. 2 is described. In this preferred embodiment, a high shear type turbine mixer 180 is provided in the fuel supply line which supplies a boiler fuel 131 from the fuel storage tank 130 to the boiler 10. The other construction is same as that of FIG. 1.

By providing the high shear type turbine mixer 180, a fuel in which the water content in the heavy oil is accelerated to produce fine particles is supplied to the boiler 10. As the fuel, after being atomized in the boiler 10, is made into finer particles by explosion of the fine particles of water, and the heavy oil is made into finer particles, thus improving the combustibility of the heavy oil.

(Third preferred embodiment)

Figure 3:
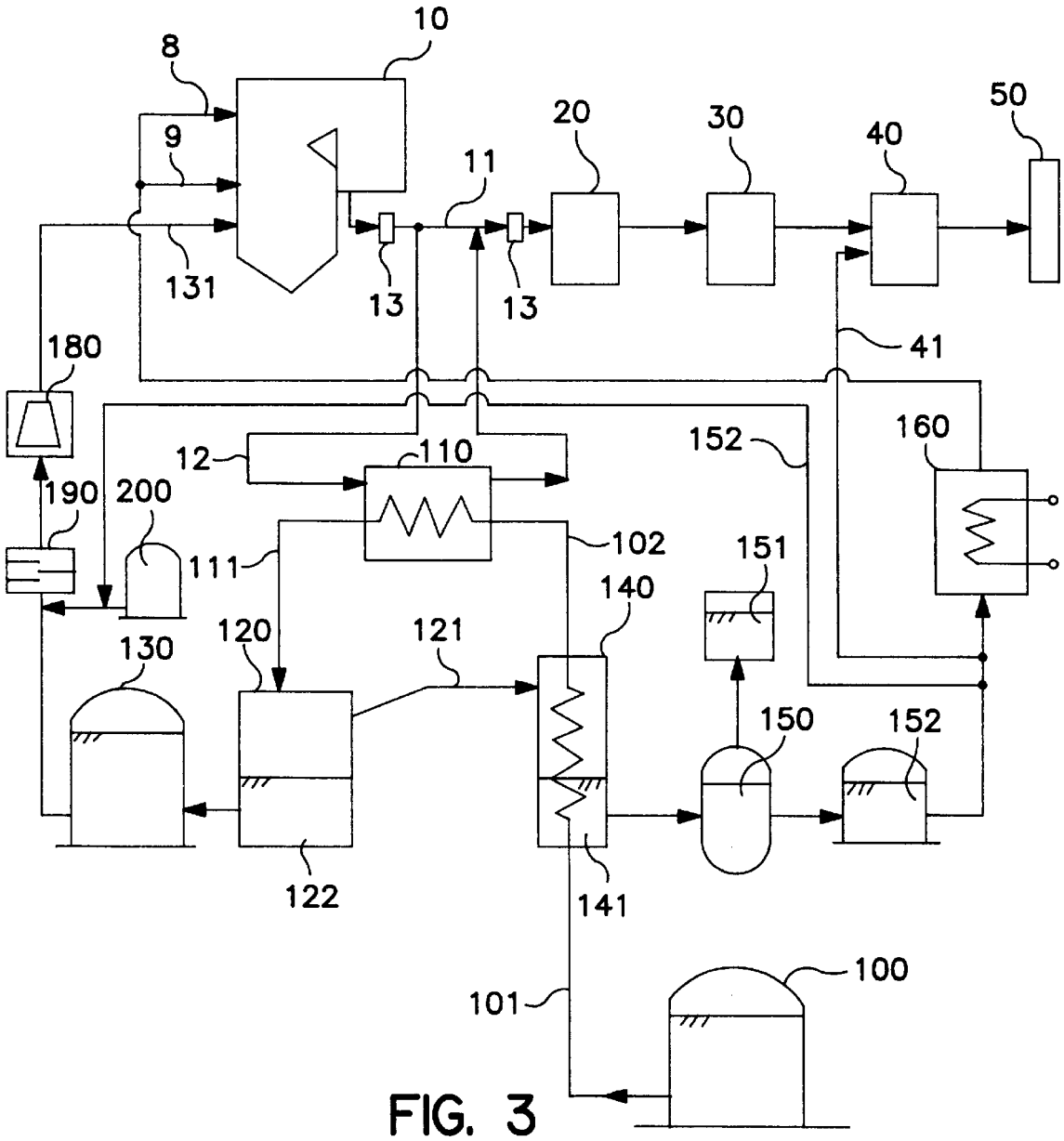
FIG. 3 is a diagrammatic view of a heavy oil emulsified fuel combustion apparatus in accordance with a third preferred embodiment of the present invention.

A third preferred embodiment according to the present invention shown in FIG. 3 is described. In this preferred embodiment, there is employed a construction in which a line blender 190 is provided upstream of the high shear type turbine mixer 180 in the fuel supply line extending from the fuel storage tank 130 to the boiler 10 and upstream of the line blender 190, at least one of the separated water 152 and an additive 200 is delivered. Other elements of the construction are the same as that of FIG. 2.

By employing such a construction, at least one of the water 152 and the additive 200 is added and pre-mixed in the fuel 131 by the action of the line blender 190, thereby forming a water-in-oil type emulsion and the water is accelerated to produce fine particles. Hence, fine particles produced by boiling in the boiler 10 are further accelerated.

(Fourth preferred embodiment)

Figure 4:
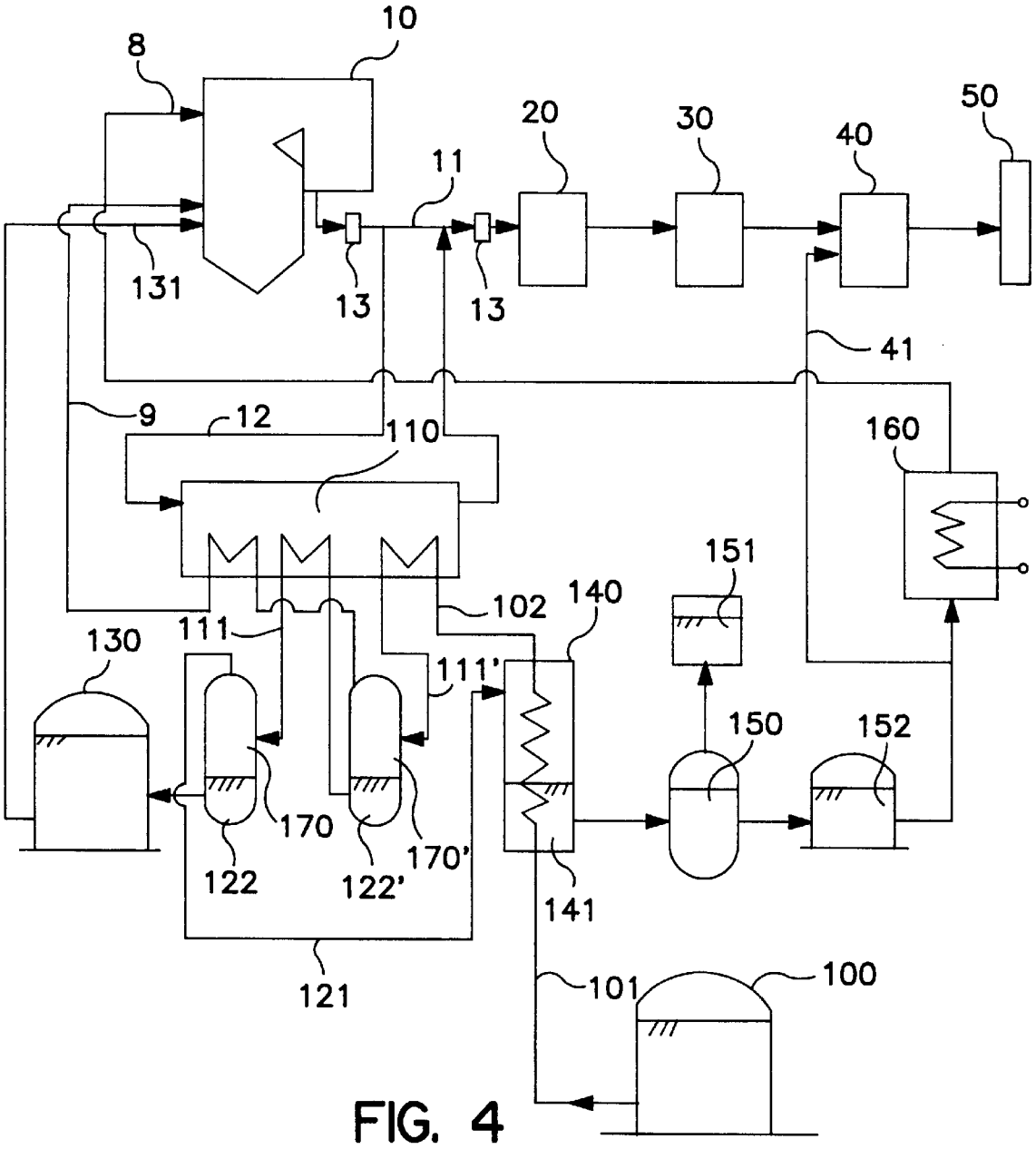
FIG. 4 is a diagrammatic view of a heavy oil emulsified fuel combustion apparatus of a fourth preferred embodiment of the present invention.

A fourth preferred embodiment according to the present invention shown in FIG. 4 is described. Like the prior art boiler shown in FIG. 14, the fourth preferred embodiment includes a fuel supply line in the heavy oil emulsified fuel combustion boiler having a boiler unit 10, a flue gas treatment line of an $NO_X$, removal apparatus 20, a dust removal apparatus 30, a wet type $SO_X$ removal apparatus 40 and a stack 50, etc. The boiler shown in FIG. 4 is also provided with a dewatering system for dewatering the water content in the heavy oil emulsified fuel.

That is, the dewatering system in the combustion boiler shown in FIG. 4 is composed of a heavy oil emulsified fuel tank 100, a heavy oil emulsified fuel heater 110, flashers 170, 170', a storage tank 130 of fuel, after being dewatered, a condenser 140 of the vapor obtained by the dewatering process, an oily water separator 150, a water reheater 160, etc.

The fuel sent from a heavy oil emulsified fuel production source is stored in the fuel tank 100. The heavy oil emulsified fuel 101 supplied from the tank 100 via a pump (not shown) absorbs a latent heat of the vapor 121 at the condenser 140 to increase the temperature thereof.

The heavy oil emulsified fuel 102 coming out of the condenser 140 is further heated by the heater 110 to a temperature at which the water content in the heavy oil emulsified fuel 102 can be vaporized, and is than supplied to the flashers 170', 170. The heater 110 and the flashers are required to be made in multi-stages in order to reduce the water content in the heavy oil content 122 to less than 1%. In FIG. 4, two-stage flashers 170, 170' are shown. The heat of a partial gas 12 from the boiler flue gas 11 is used as a heat source.

The high temperature fuel 111', 111 supplied to the flashers 170', 170 is separated into a heavy oil 122', 122 and a vapor 121 consisting of steam and a light oil combustible gas. The heavy oil 122 is stored in the fuel storage tank 130 and is then supplied to a burner port of the boiler 10 as boiler fuel 131.

Incidentally, as the heavy oil 122 will lose flowability at the ordinary temperatures, the fuel storage tank 130, pipings to the burner port, etc. are required to be heated in order to maintain the flowability.

The vapor 9, obtained at the front stage flasher 170', is re-heated by the heater 110 and is than supplied to the burner port. The vapor 121 obtained at the rear stage flasher 170 is supplied into the condenser 140 to heat the heavy oil emulsified fuel 101 of the ordinary temperature and is then condensed to become liquid 141 in which water and a light oil are mixed.

In order to effectively make use of the water and the light oil, respectively, in the same system, the liquid 141 is separated into oil 151 and water 152 by the oily water separator 150, and the oil 151 is used as a fuel for a boiler igniting torch etc. and the water 152 is used both as a cooling water 41 for the $SO_X$ removal apparatus 40 and partially, after being heated by the reheater 160, as a soot blowing steam 8 in the boiler, etc.

The soot blowing steam 8 is indispensable for the boiler 10, and water which would have to be made available from other sources if no water is obtained from the fuel according to the present invention can be supplied from the water in the fuel, hence the water supplied to the boiler 10 can be greatly reduced and efficiency enhancement of the boiler 10 and reliability enhancement of the downstream machinery and equipment can be attained.

(Fifth preferred embodiment)

Figure 5:
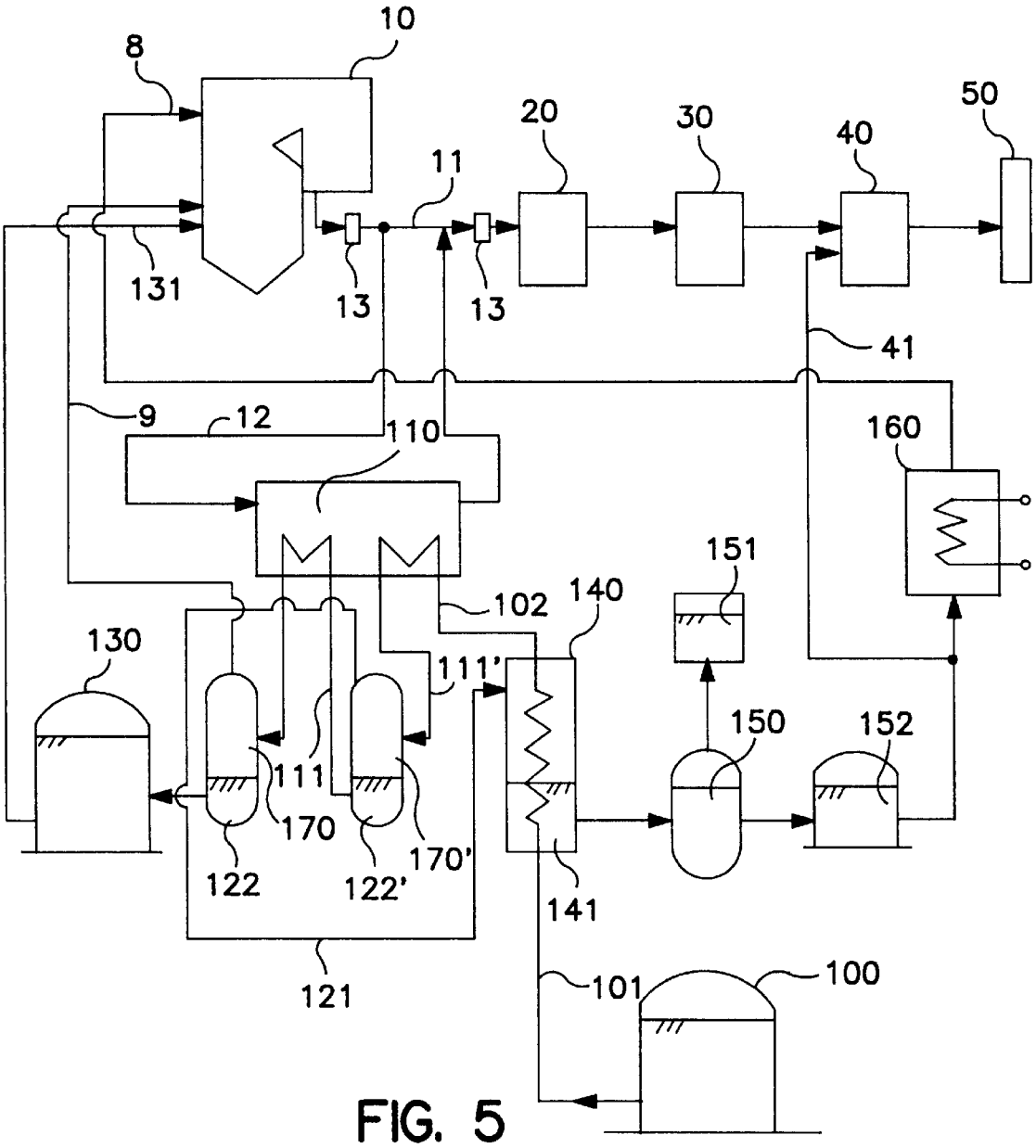
FIG. 5 is a diagrammatic view of a heavy oil emulsified fuel combustion apparatus of a fifth preferred embodiment of the present invention.

A fifth preferred embodiment according to the present invention shown in FIG. 5 is described. In this preferred embodiment, as in the fourth preferred embodiment, a heater 110 and flashers 170, 170' in two stages are provided. The vapor obtained at the rear stage flasher 170 is supplied to the burner port as an atomizing steam 9 and the vapor 121 obtained at the front stage flasher 170' is supplied to the condenser 140 for recovery of its latent heat.

(Sixth preferred embodiment)

Figure 6:
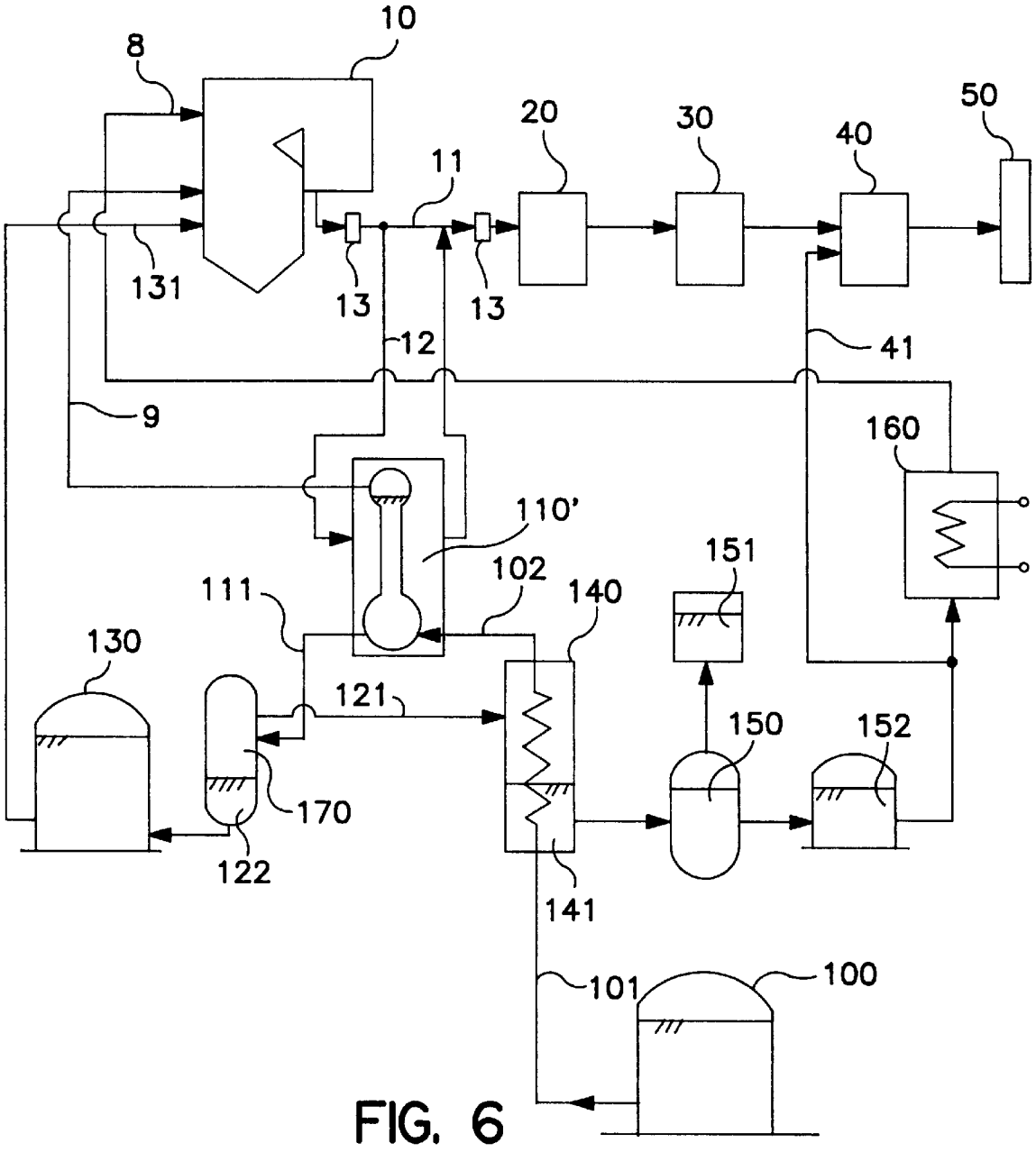
FIG. 6 is a diagrammatic view of a heavy oil emulsified fuel combustion apparatus of a sixth preferred embodiment of the present invention.

A sixth preferred embodiment according to the present invention shown in FIG. 6 is described. In the boiler shown in FIG. 6, a fuel supply line, in the heavy oil emulsified fuel combustion boiler, includes a boiler unit 10, a flue gas treatment line of an $NO_X$ removal apparatus 20, a dust removal apparatus 30, a wet type $SO_X$ removal apparatus and a stack 50, etc. Also, provided is a dewatering system for dewatering the water content in the heavy oil emulsified fuel.

The dewatering system in this preferred embodiment is composed of a heavy oil emulsified fuel tank 100, a heavy oil emulsified fuel circulation boiler 110', a flasher 170, a storage tank 130 for dewatered fuel, a vapor condenser 140 obtained by dewatering, an oily water separator 150, a water reheater 160, etc.

The fuel, delivered from a heavy oil emulsified fuel production source, is stored in the fuel tank 100. The heavy oil emulsified fuel 101 supplied from the tank 100 via a pump (not shown) absorbs the latent heat of the vapor 121 at the condenser 140 so as to be elevated in temperature. Further, water content and a light oil content of the heavy oil emulsified fuel 102, heated at the circulation boiler 110', are vaporized and supplied to the flasher 170.

The heat of a partial gas 12 from the boiler flue gas 11 is used as a heat source for the circulation boiler 110'. The high temperature fuel 111, supplied to the flasher 170, is separated into vapor 121 consisting of water and a light oil combustible gas remaining in the heavy oil. Also, heavy oil 122 is stored in the fuel storage tank 130 and is then supplied to a burner port of the boiler 10 as a boiler fuel 131.

Incidentally, as the heavy oil content 122 loses flowability at ordinary temperatures, the fuel storage tank 130, pipings to the burner port, etc. are required to be heated in order to maintain the flowability. Steam 9, obtained at the circulation boiler 110', is supplied to the burner port as an atomizing steam.

Vapor 121 obtained at the flasher 170 is, for a purpose to recover its latent heat, supplied into the condenser 140 to provide heat to the heavy oil emulsified fuel 101 of the ordinary temperature and is then condensed to become a liquid 141 comprising a mixture of water and light oil.

In order to effectively make use of the water and the light oil, respectively, in the same system, the liquid 141 is separated into oil 151 and water 152 by the oily water separator 150. The oil 151 is used as a fuel for a boiler igniting torch etc. and the water 152 is used partially as a cooling water 41 for the $SO_X$ removal apparatus 40 and partially, after being heated by the reheater 160, as a soot blowing steam 8 in the boiler, etc.

The soot blowing steam 8 is indispensable for the boiler 10, and water, which would have to be made available from other sources if no water is obtained from the fuel according to the present invention, is supplied by the water in the fuel. Thus, the amount of water supplied to the boiler 10 can be greatly reduced and the efficiency of the boiler 10 and the reliability of the downstream machinery and equipment can be enhanced.

(Seventh preferred embodiment)

Figure 8:
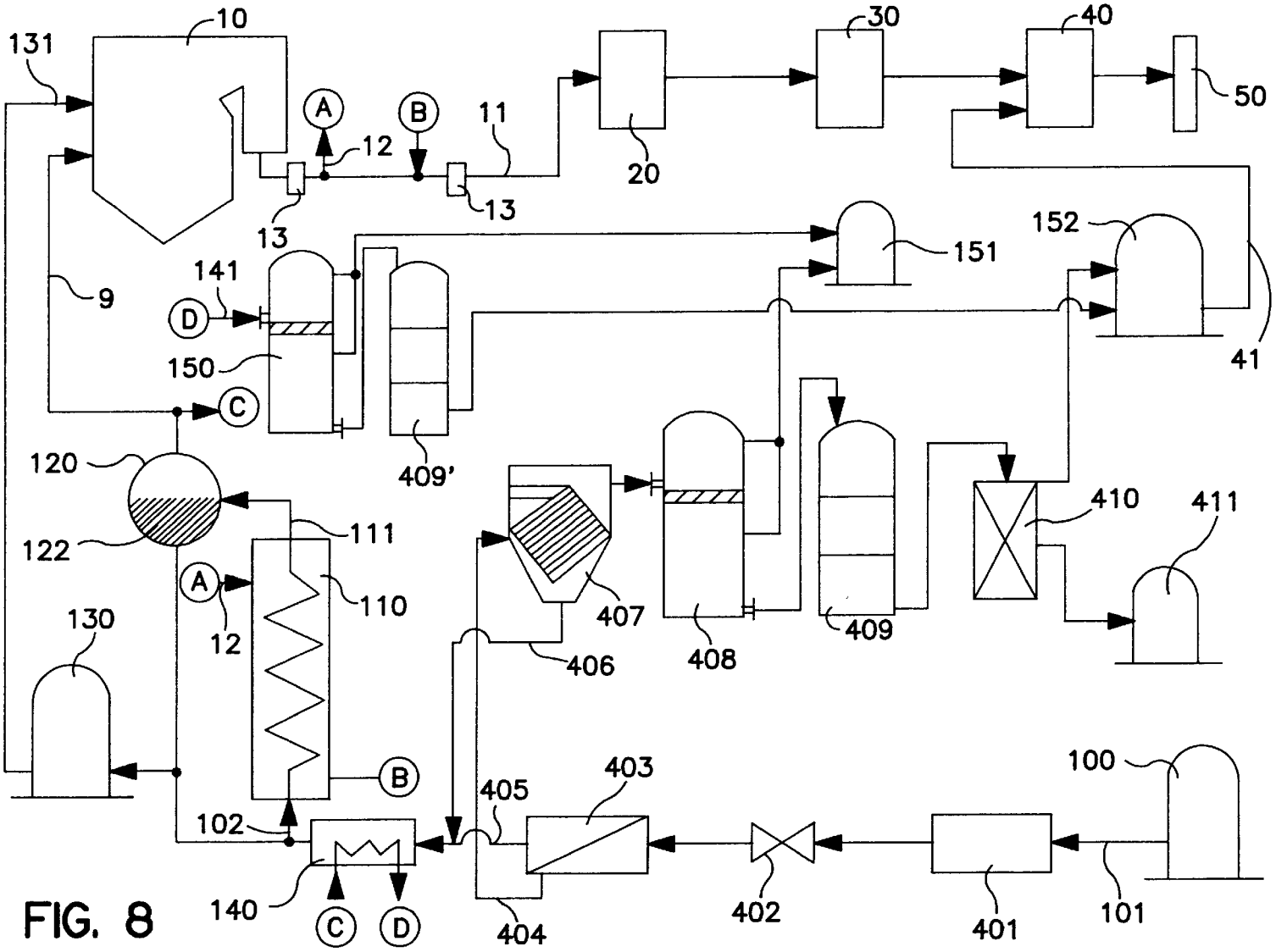
FIG. 8 is a diagrammatic view of a heavy oil emulsified fuel combustion apparatus of a seventh preferred embodiment of the present invention.

A seventh preferred embodiment according to the present invention shown in FIG. 8 is described. In a boiler shown in FIG. 8, a fuel supply line, in the heavy oil emulsified fuel combustion boiler, includes a boiler unit 10, a flue gas treatment line of an $NO_X$ removal apparatus 20, a dust removal apparatus 30, a wet type $SO_X$ removal apparatus and a stack 50, etc. Also, provided is a dewatering system for dewatering the water content in the heavy oil emulsified fuel.

The dewatering system in this preferred embodiment is composed of a heavy oil emulsified fuel tank 100, a liquid-liquid separator 403, a heavy oil emulsified fuel heater 110, a dewatered fuel storage tank 130, a vapor condenser 140 for vapor obtained by dewatering, an oily water separator 150, a heavy oil separator 407, a light oil separator 408, oil adsorption towers 409, 409', a salt concentrator 410, etc.

The fuel delivered from a heavy oil emulsified fuel production source is stored in the fuel tank 100. The heavy oil emulsified fuel 101 supplied from the tank 100 via a pump (not shown) is heated by a preheater 401. The heating temperature in this case is higher than 50° C., preferably higher than 70° C.

The preheated heavy oil emulsified fuel is, while it passes through an orifice 402, added with shears, thereby sizes of oil particles become increased. High shear type mixing means which can be employed other than the orifice are a turbine mixer, a colloid mill, a homogenizer, etc.

Then, the fuel passes through the liquid-liquid separator 403 and the water content of the heavy oil emulsified fuel 405 is reduced to approximately 5 to 10%.

The separated water 404 obtained at the liquid-liquid separator 403 passes through the heavy oil separator 407, the light oil separator 408, the oil adsorption tower 409 and the salt concentrator 410 so that the oil content in the water is reduced finally to less than 10 ppm, preferably less than 1 ppm, and then is stored in a water tank 152. Numeral 411 designates a salt concentrated water including an inorganic salt.

The heavy oil emulsified fuel 405 with a portion of water content removed at the liquid-liquid separator 403, is combined with a heavy oil 406 separated at the heavy oil separator 407, passes through the condenser 140, the heater 110 and a water vaporizer 120 to be heated and dewatered, and is then sent to the fuel storage tank 130. During the operation of heating and vaporizing, the water and the light oil are removed, so that a fraction of lower temperature than 200° C. is made less than 2%, preferably less than 1%, of the heavy oil.

A portion of the vapor of the water and the light oil obtained at the water vaporizer 120 is used as a fuel atomizing steam 9 for the boiler 10 and the remaining portion becomes liquid by heat exchange with the heavy oil emulsified fuel 405 and is sent to the oily water separator 150. The separated light oil is stored in a tank 151. The separated water is removed of its oil content at the oil adsorption tower 409' and is sent to the tank 152.

(Eighth preferred embodiment)

Figure 9:
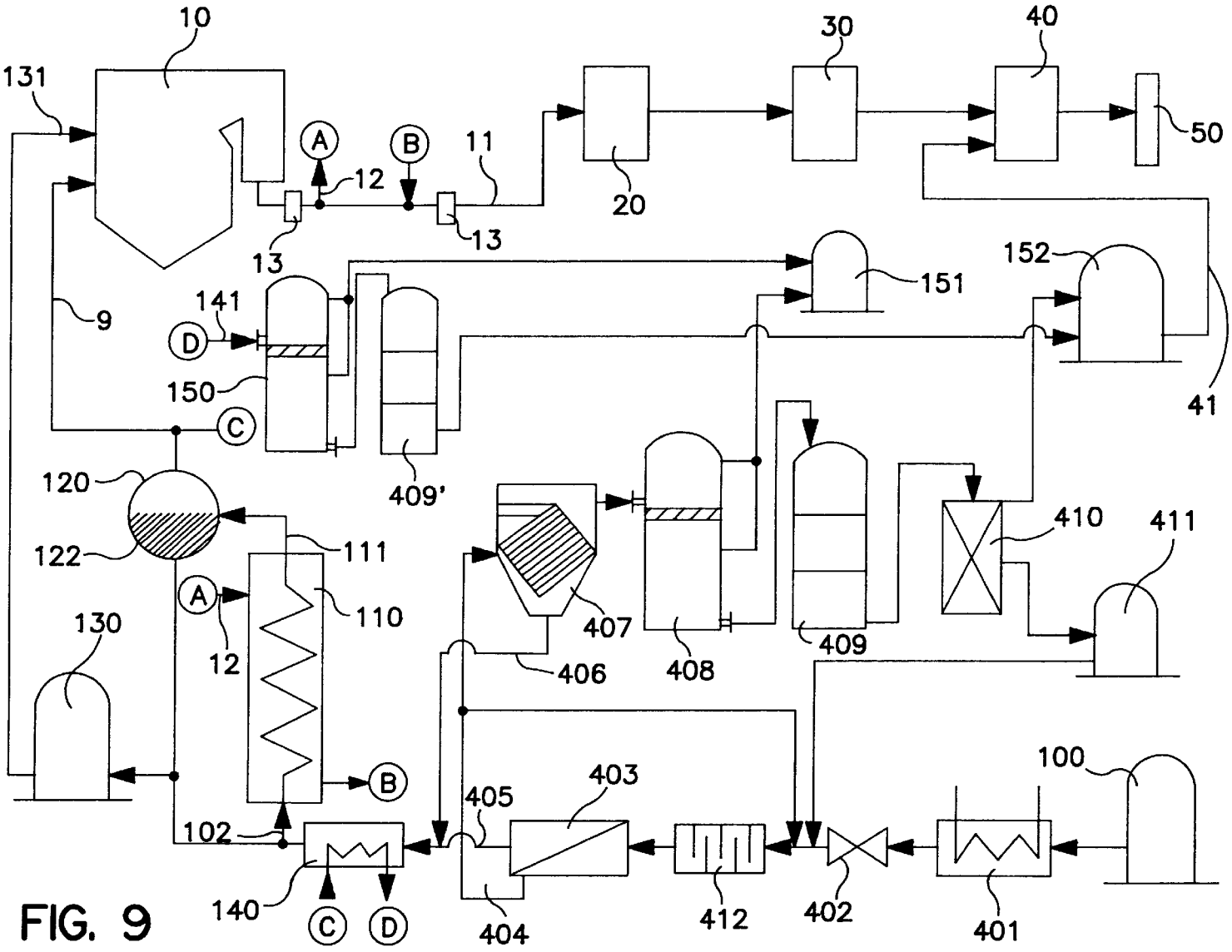
FIG. 9 is a diagrammatic view of a heavy oil emulsified fuel combustion apparatus of an eighth preferred embodiment of the present invention.

An eighth preferred embodiment according to the present invention shown in FIG. 9 is described. In this preferred embodiment, as compared with the seventh preferred embodiment shown in FIG. 8, a portion of the separated water 404 obtained at the liquid-liquid separator 403 and the salt concentrated water 411 including an inorganic salt are circulated to the upstream side of a line blender 412 provided upstream of the liquid-liquid separator 403. Thereby, the viscosity of the heavy oil emulsified fuel at the time of the liquid-liquid separation is reduced.

Figure 10:
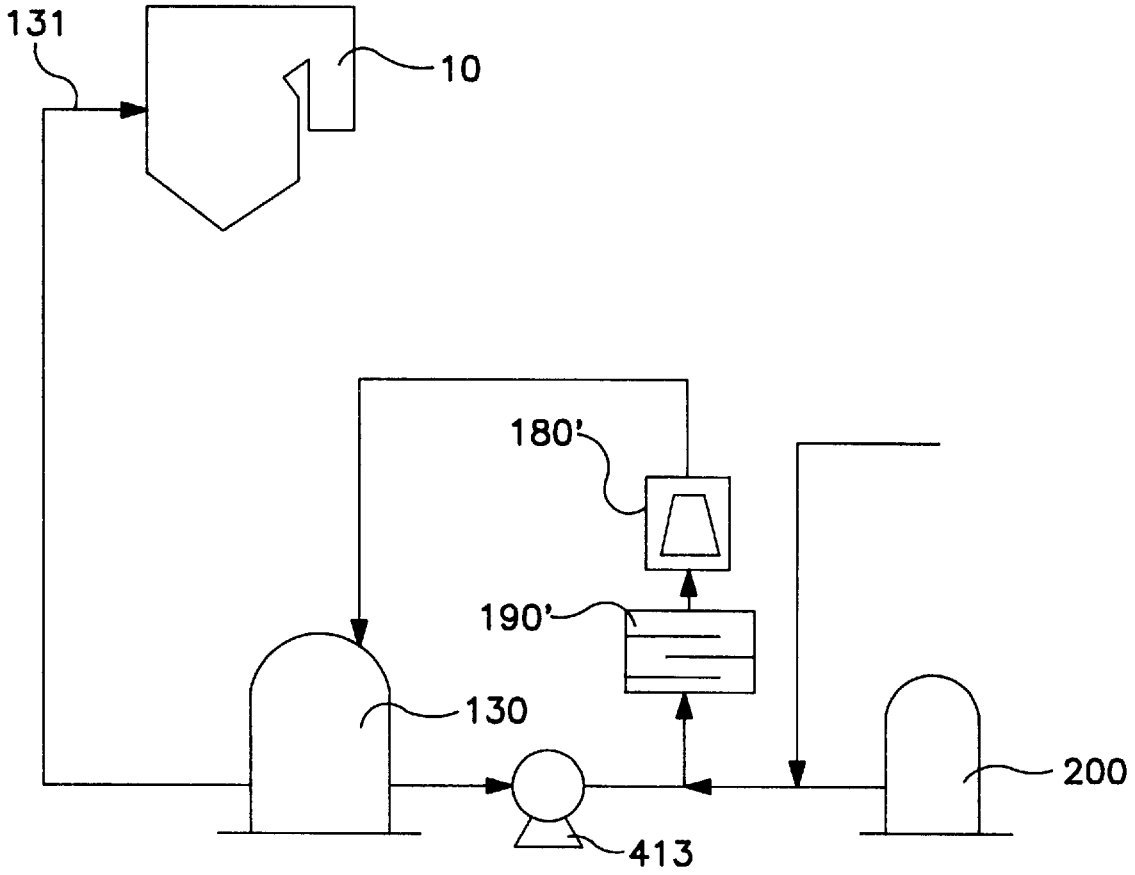
FIG. 10 is a diagrammatic view showing an example of a fuel character adjusting line in the seventh and the eighth preferred embodiments of the present invention.
Figure 11:
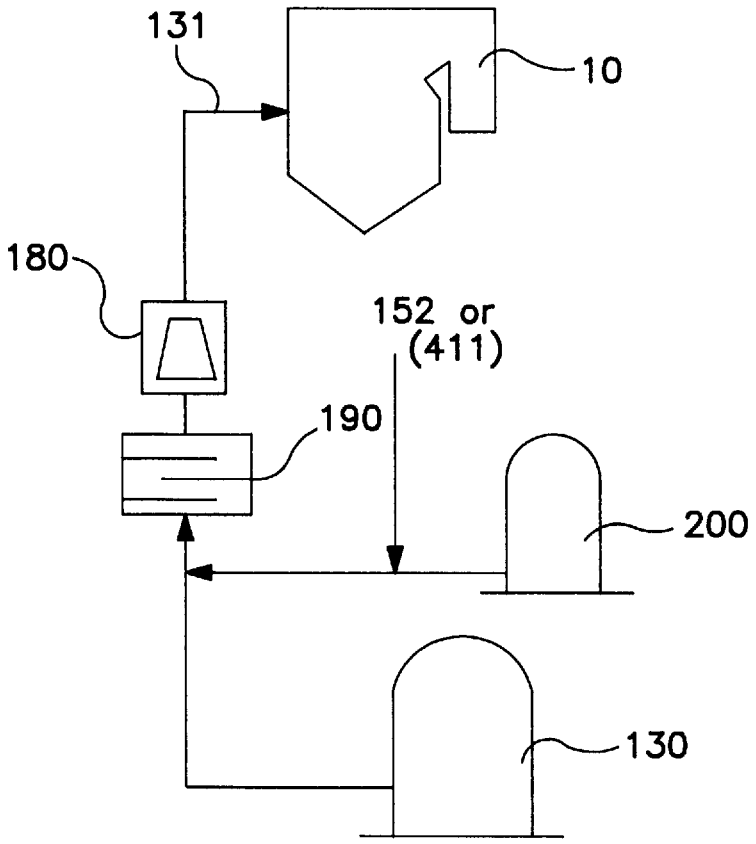
FIG. 11 is a diagrammatic view showing an example of another construction of a fuel character adjusting line in the seventh and the eighth preferred embodiments of the present invention.
Figure 12:
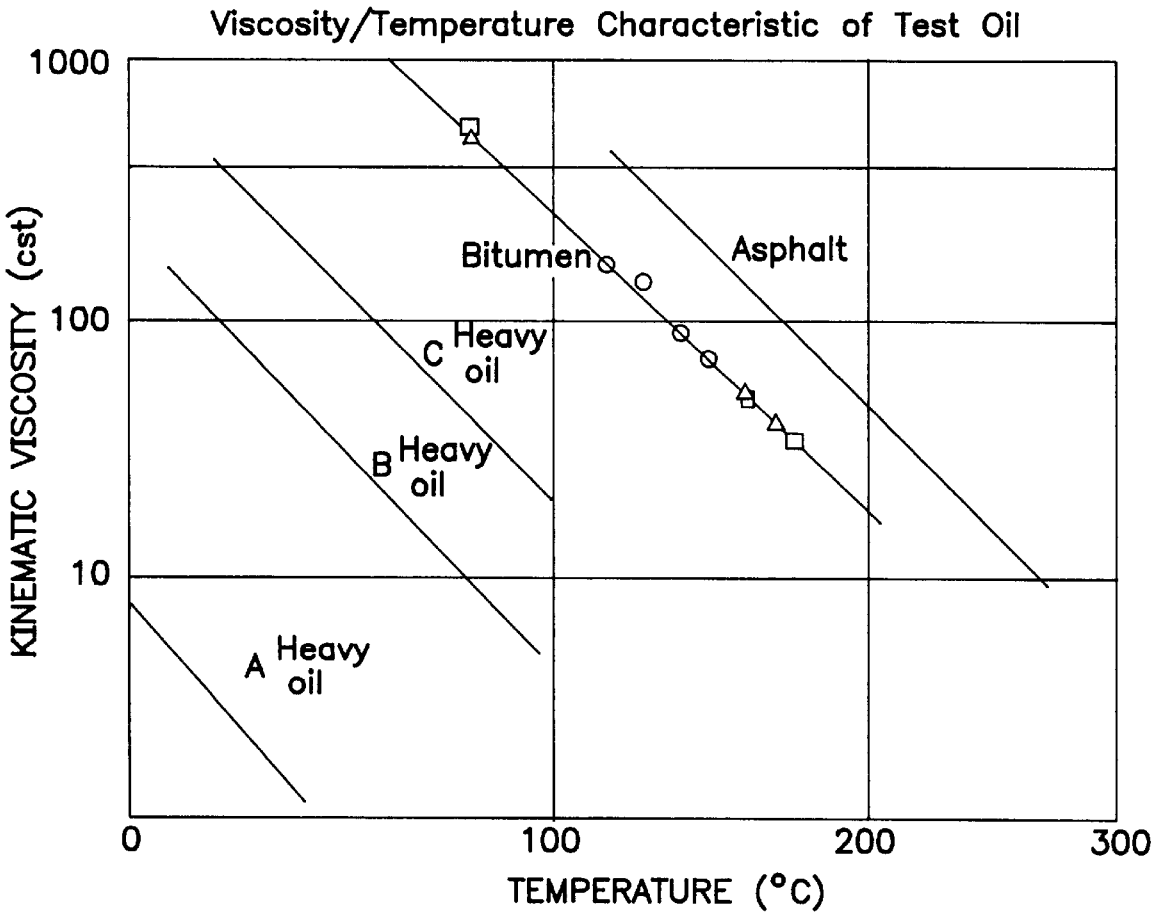
FIG. 12 is a graph showing relationships between viscosity and temperature of heavy oils.
Figure 13:
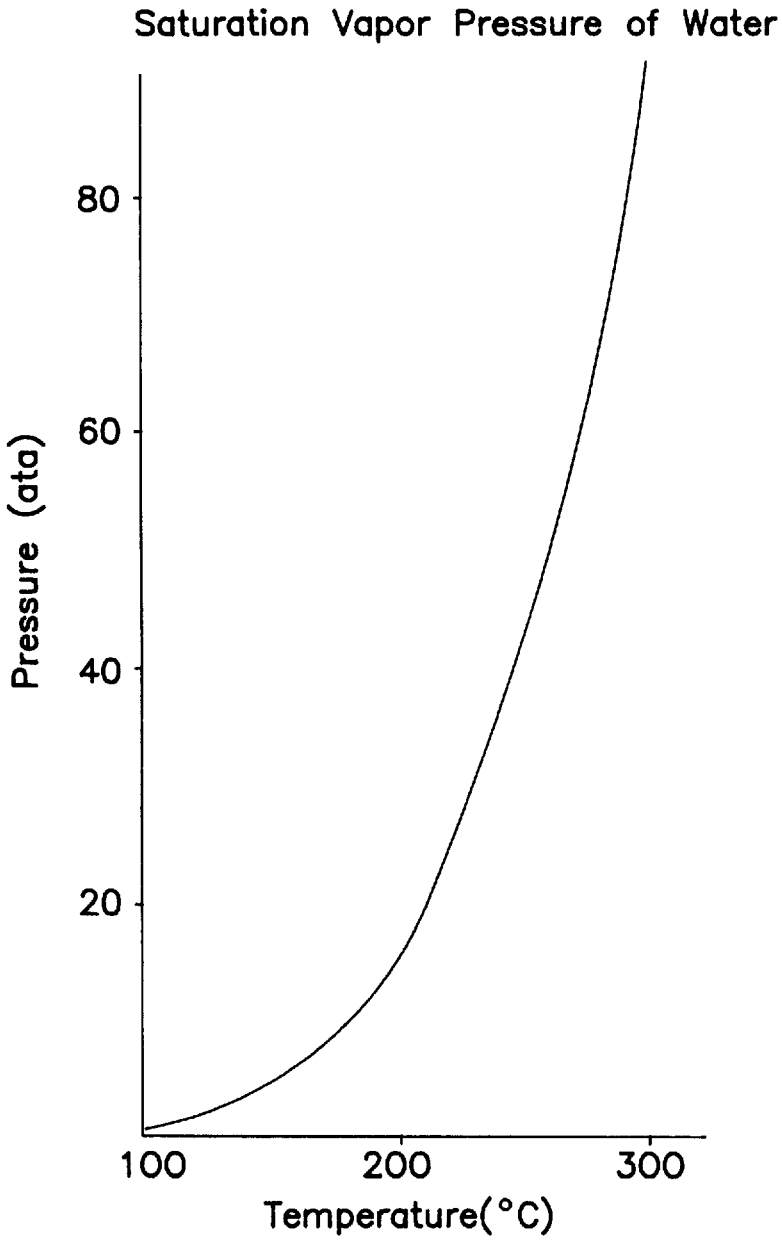
FIG. 13 is a graph showing a saturation vapor pressure of water.

Next, by use of FIGS. 10 and 11, character adjusting methods of the heavy oil fuel after being separated of water by the seventh and the eighth preferred embodiments are described.

In FIG. 10, the fuel is circulated from a fuel storage tank 130 through a circulation pump 413, a line blender 190' and a high shear type turbine mixer 180', and separated water from water tank 152 or a salt concentrated water tank 411 and an additive, for example, a nonionic surface active agent of a polyoxyethylene nonyl phenyl ether (HLB 1 to 20) etc., from an additive tank 200 are poured into the upstream side of the line blender 190'. The amount of additive is less than 0.5% of the heavy oil. Thereby, the water content in the fuel is 0.5 to 10%, preferably 1 to 5%, and a water-in-oil type emulsion in which sizes of water particles in oil are less than 100 $\mu$m, preferably less than 50 $\mu$m, is formed.

In FIG. 11, in the line for supplying fuel 131 from a fuel tank 130 to a boiler 10, a line blender 190 and a high shear type turbine mixer 180 are interposed, and a separated water from a water tank 152 or a salt concentrated water tank 411 and an additive from an additive tank 200 are provided at the upstream side of the line blender 190, thus the character of the fuel is adjusted and is supplied to the boiler 10.

In the above, preferred embodiments according to the present invention are described with reference to figures, but, needless to mention, the present invention is not limited to the preferred embodiments but includes various changes without departing from the spirit and scope of the appended claims.

For example, in the first preferred embodiment, it is so constructed that all of the vapor 121 obtained by the heavy oil emulsified fuel being heated at the heater 110 is condensed at the condenser 140, but there may be a construction in which not all of the steam and light oil combustible gas vaporized by the heavy oil emulsified fuel being heated is condensed but a portion of the vapor is used for atomizing at the boiler burner and, for a cooling water of the $SO_X$ removal apparatus, only the water condensed and separated of oil completely is used, etc., thus the vapor can be used in relation to the purpose of its use. Also, as for the heater 110, it may be employed from a heater of other appropriate type than that using a heat pipe.

Further, in the above preferred embodiments, those applied to a boiler are described, but it is easily understood that the present invention can be applied to a combustion furnace, such as a gasification furnace, a heating furnace of various kinds, etc., other than a boiler.

As described above, in the heavy oil emulsified fuel combustion boiler according to the present invention, there is employed a construction in which the heavy oil emulsified fuel is heated and dewatered and then is supplied to the boiler and at least a portion of the water obtained by the dewatering is supplied to the water utilizing line of the boiler. Thereby the amount of water to be supplied to the heavy oil emulsified fuel combustion boiler can be greatly reduced, and efficiency enhancement of boiler as well as reliability enhancement of the downstream machinery and equipment by solving problems associated with the elevation of sulfuric acid dew point, such as soot and dust sticking, accumulating or blocking, can be attained.

Further, according to the construction of the present invention in which fine particles of water are contained in the heavy oil fuel supplied to boiler, combustibility of the heavy oil in the boiler is remarkably improved.

What is claimed is:

1. A method of supplying fuel in a heavy oil emulsified fuel apparatus, the method comprising:

supplying heavy oil emulsified fuel to a heavy oil emulsified fuel dewatering system;

heating the heavy oil emulsified fuel;

dewatering the heated heavy oil emulsified fuel;

supplying the dewatered heavy oil emulsified fuel to a combustion furnace; and supplying at least a portion of the water, recovered during said dewatering process, to at least one water utilization line of said combustion furnace.

2. The method as claimed in claim 1, wherein said heating of the heavy oil emulsified fuel utilizes a combustion flue gas from said combustion furnace.

3. The method as claimed in claim 2, wherein said heating of the heavy oil emulsified fuel employs a heat pipe.

4. The method as claimed in claim 2, wherein said heating of the heavy oil emulsified fuel employs a circulation boiler.

5. The method as claimed in claim 2, wherein a first economizer is provided on an upstream side of a take-out portion of the combustion furnace flue gas and a second economizer is provided on a downstream side of a return portion of the combustion furnace flue gas.

6. The method as claimed in claim 1 wherein said at least one water utilization line comprises a burner atomizing steam line, a soot blowing steam line and an $SO_X$ removal apparatus cooling water line.

7. The method as claimed in claim 1, wherein steam and a light oil combustible gas are generated during said heavy oil emulsified heating process, and said method further comprises condensing said steam and said light oil combustible gas, and separating said condensed steam and said condensed light oil combustible gas.

8. The method as claimed in claim 7, wherein said steam and said light oil combustible gas are cooled during said condensing process by heat exchange with heavy oil emulsified fuel prior to heating said heavy oil emulsified fuel.

9. The method as claimed in claim 1, the heavy oil emulsified fuel is dewatered by at least two units of apparatuses for heating and dewatering the heavy oil emulsified fuel.

10. The method as claimed in claim 1, wherein said dewatering of the heavy oil emulsified fuel results in a dewatered fuel having a water content of 5 to 10%, and said method further comprises breaking up water particles remaining in the dewatered fuel with a high shear fine particle making means.

11. The method as claimed in claim 10, further comprising adding a surface active agent to the dewatered heavy oil emulsified fuel.

12. The method as claimed in claim 10, further comprising adding water via a water make-up line when the water content in the dewatered fuel is low.

13. The method as claimed in claim 10, wherein said high shear fine particle making means is provided in a circulation line of a fuel tank or a fuel supply line.

14. The method as claimed in claim 1, further comprising partially dewatering said heavy oil emulsified fuel, prior to said heating and dewatering operations, by use of a liquid-liquid separator.

15. The method as claimed in claim 14, further comprising circulating a portion of the water, recovered by said liquid-liquid separator, to an upstream side of said liquid-liquid separator.

16. A heavy oil emulsified fuel combustion apparatus comprising:

a combustion furnace;

a heavy oil emulsified fuel source;

a dewatering system connected to said heavy oil emulsified fuel source for removing water from the heavy oil emulsified fuel;

a dewatered fuel storage tank fluidly connected to said dewatering system for receiving dewatered fuel therefrom, said dewatered fuel storage tank being fluidly connected to said combustion furnace via a fuel supply line for supplying fuel to said combustion furnace; and at least one water utilization line fluidly connecting said dewatering system to said combustion furnace, wherein at least a portion of the water removed from the heavy oil emulsified fuel by said dewatering system is supplied to said combustion furnace via said water utilization line.

17. The heavy oil emulsified fuel combustion apparatus, as claimed in claim 16, wherein said at least one water utilization line comprises a burner atomizing steam line.

18. The heavy oil emulsified fuel combustion apparatus, as claimed in claim 16, wherein said at least one water utilization line comprises a soot blowing steam line.

19. The heavy oil emulsified fuel combustion apparatus, as claimed in claim 16, wherein said at least one water utilization line comprises a cooling water line for a $SO_X$ removal apparatus.

20. The heavy oil emulsified fuel combustion apparatus, as claimed in claim 16, wherein said dewatering system comprises:

a heavy oil emulsified fuel heater for heating fuel received from said heavy oil emulsified fuel source;

a vaporizer connected to an outlet of said heavy oil emulsified fuel heater;

a vapor condenser connected to said an outlet of said vaporizer;

an oil-water separator connected to an outlet of said condenser; and a water reheater for receiving and heating water from said oil-water separator.

21. The heavy oil emulsified fuel combustion apparatus as claimed in claim 20, wherein said heavy oil emulsified fuel heater comprises a heat pipe.

22. The heavy oil emulsified fuel combustion apparatus as claimed in claim 20, wherein said heavy oil emulsified fuel heater comprises a circulation boiler.

23. The heavy oil emulsified fuel combustion apparatus as claimed in claim 20, wherein said condenser is disposed such that the heavy oil emulsified fuel flows through said condenser upstream of said heavy oil emulsified fuel heater.

24. The heavy oil emulsified fuel combustion apparatus as claimed in claim 20, further comprising a first economizer for receiving a flue gas from said combustion furnace, and a second economizer disposed downstream of said first economizer for receiving a return flow of flue gas from said fuel heater.

25. The heavy oil emulsified fuel combustion apparatus as claimed in claim 20, further comprising a liquid-liquid separator for partially dewatering the heavy oil emulsified fuel before it is heated by said heavy oil emulsified fuel heater.

26. The heavy oil emulsified fuel combustion apparatus as claimed in claim 25, wherein a portion of the water separated by said liquid-liquid separator is circulated to an upstream side of said liquid-liquid separator via a water recirculation line.

27. The heavy oil emulsified fuel combustion apparatus as claimed in claim 16, further comprising a high shear fine particle making means disposed downstream of said dewatered fuel storage tank.

28. The heavy oil emulsified fuel combustion apparatus as claimed in claim 16, wherein said combustion furnace is a boiler.

29. The heavy oil emulsified fuel combustion apparatus as claimed in claim 16, wherein said combustion furnace a gasification furnace.

30. The heavy oil emulsified fuel combustion apparatus as claimed in claim 16, wherein said combustion furnace is a heating furnace.

* * * * *